US006575087B2

(12) United States Patent
Shiga et al.

(10) Patent No.: US 6,575,087 B2
(45) Date of Patent: Jun. 10, 2003

(54) PRESS MACHINE HAVING SUSPENSION MECHANISM

(75) Inventors: Masakatsu Shiga, Machida (JP); Noriyuki Shimizu, Sagamihara (JP); Naonori Taniguchi, Sagamihara (JP)

(73) Assignee: Aida Engineering, Ltd., Sagamihara (JP)

( * ) Notice: Subject to any disclaimer, the term of this patent is extended or adjusted under 35 U.S.C. 154(b) by 0 days.

(21) Appl. No.: 10/145,900

(22) Filed: May 16, 2002

(65) Prior Publication Data

US 2002/0170445 A1 Nov. 21, 2002

(30) Foreign Application Priority Data

May 17, 2001 (JP) ..... 2001-147243

(51) Int. Cl.[7] ..... B30B 5/00; B30B 1/08
(52) U.S. Cl. ..... 100/257; 100/271
(58) Field of Search ..... 100/257, 258 A, 100/282, 271, 292; 72/453.03, 454, 455, 448; 83/530

(56) References Cited

U.S. PATENT DOCUMENTS 4,150,618 A * 4/1979 Spanke et al. ..... 100/257
4,166,415 A * 9/1979 Spanke et al. ..... 100/346
4,823,687 A * 4/1989 Yonezawa et al. ..... 100/346
5,349,902 A * 9/1994 Daniel et al. ..... 100/48
5,609,099 A * 3/1997 Burns et al. ..... 100/257
5,791,240 A * 8/1998 Yagi et al. ..... 100/257

* cited by examiner

*Primary Examiner*—Allen Ostrager
*Assistant Examiner*—Jimmy T Nguyen
(74) *Attorney, Agent, or Firm*—Oblon, Spivak, McClelland, Maier & Neustadt, P.C.

(57) ABSTRACT

A suspension mechanism is formed as a liquid-tight structure by fitting the bottom end of a female screw member using a liquid-tight sealing member provided between a slider and a retainer and by covering the retainer with the liquid-tight sealing member. A highly-pressurized liquid is initially supplied to each clearance formed between any components such as liquid-tight sealing member, female screw member, male screw member and retainer through a liquid supply passage formed through the liquid-tight sealing member. The highly-pressurized liquid is supplied by an amount flows out through the screwing portions between the male and female screw members to maintain the pressure of liquid within the liquid-tight structure in a predetermined range.

13 Claims, 5 Drawing Sheets

PRESS MACHINE HAVING SUSPENSION MECHANISM

Japanese patent application no. 2001-147243 filed on May 17, 2001 is hereby incorporated by reference in its entirety.

BACKGROUND OF THE INVENTION

The present invention relates to a press machine in which a drive mechanism and a slider are interconnected through a suspension mechanism.

FIG. 5 shows a press machine 1P in which a drive mechanism (e.g., crank mechanism 10) and a slider 5 are interconnected through a suspension mechanism 20P.

Referring to FIG. 5, the press machine 1P also comprises a crown 2, columns 3 and a bed 7. On the bed 7 is placed guides 8 each for slidably guiding a guide rod 6 connected to the slider 5.

The suspension mechanism 20P comprises a connecting rod 21 connected to a crank shaft 11, the top end of which forms the drive mechanism 10, a male screw member 23P rotatably connected to the bottom end of the connecting rod 21 through a pin 22, a female screw member 37P screwed over the male screw member 23P to form a slider positioning device 30P together with the male screw member 23P and a retainer 25P having a top end located within the cylindrical bottom of female screw member 37P and a bottom end integrally connected with the slider 5, the retainer also including a mounting member 26P integrally formed therewith.

The slider positioning device 30P comprises a motor 31P, a rotational-power transmission mechanism 32P including various gear wheels, a worm shaft and a worm wheel 35P. The worm wheel 35P is fixedly connected with the female screw member 37P through a key 36P for synchronous rotation.

As the motor 31P is rotatably started, the female screw member 37P may be rotated relative to the fixed male screw member 23P and moved up and down along the axis Z thereof. Thus, the vertical position of the slider 5 carried on the female screw member 37P may be regulated. Such a screw structure (or connection) is lubricated by oil which is gravity-supplied onto the periphery of the male screw member 23P through a longitudinal oil groove 23MZ formed thereon. After being lubricated, the oil is collected at the bottom end of the oil groove 23MZ for re-circulation.

When the drive mechanism 10 is started after the slider has been positioned, the connecting rod 21 is swingably moved to repeatedly move the male screw member 23P, female screw member 37P and retainer 25P (26P) up and down. Thus, the slider 5 may repeatedly be moved between the top and bottom dead centers.

The entire press machine including the suspension mechanism 20P and slider positioning device 30P is structured by combining (or assembling) a great number of components. The manufacturing precision for each component is limited due to various conditions (e.g., cost, technology and load capacity). Depending on the assembling operation, it is also limited to some degree to micrify a clearance for reducing a frictional resistance to provide a smooth action. On the other hand, there may be created a clearance larger than the above-mentioned limitation between adjacent components after they have been assembled.

On the contrary, there may be frequently a case that a relatively large clearance must positively be formed between adjacent components to eliminate any influence from possible heat shrinkage and deformation.

In any case, the presence of relatively large clearance between adjacent components degrades the mechanical precision in the press machine, reduce the precision (or quality) in the pressed products and produce vibration and noise during the pressing operation.

Furthermore, the power transmission capacity may be reduced by creating a power (load) imbalance from any spacing between adjacent components (e.g., between contacting faces or between pressure receiving faces). Additionally, the system in which the slider positioning device 30P is incorporated into the suspension mechanism 20P requires a complicated lubricating/cooling mechanism for the screw parts (23P and 37P) which form part of the slider positioning device 30P. This also causes contamination of the press machine due to the flow of lubricating (or cooling) oil drops.

Depending on the size of the clearance in the slider positioning device 30P (23P and 37P), the engagement between the screw parts (23P and 37P) maybe loosened during the pressing operation. In addition, the position (or die height) of the slider 5 may be changed to increase defectives and to degrade the yield.

BRIEF SUMMARY OF THE INVENTION

The present invention may provide a press machine which may improve the mechanical precision and product precision (or quality) and greatly reduce vibration and noise by eliminating any backlash in the pressing power transmission.

In the press machine according to the present invention, the time period between the state in which the press stops and the other state in which a press load is produced after the press has been started is referred to as the "non-press load producing time". In the non-press load producing time, a first pressure layer is formed by charging a pressurized fluid into a first clearance between a first face, facing downward for example, (e.g., male screw member) of a first component selected from a plurality of components forming a suspension mechanism and a third face, facing upward for example, (e.g., female screw member) of a second component opposing the first face. Thus, a vertical clearance (or backlash) which is formed between the first and third faces apparently disappears. At the same time, the first and third faces are mechanically brought into direct contact with each other through the pressurized fluid.

At the same time, a second face (e.g., upward face) of the first component which is dynamically opposing the first face thereof is pressed against a fourth face (e.g., downward face) of the second component which is opposing to the second face, for example, under the action of an upward lifting force. Thus, a second clearance between the second and fourth faces disappears. Moreover, the second and fourth faces are brought into direct contact with each other so that no clearance (backlash) is formed therebetween.

Namely, a mechanical power-transmission connection is formed between the first component (e.g., male screw member) and the second component (e.g., female screw member) without backlash (or clearance). Thus, vibration and noise may greatly be reduced during a press startup process between a press start at which slider starts to move downward and a time whereat the press load start to be produced.

In a press load producing time in which the slider further moves downward to start the pressing operation and to continue the pressing operation, the upward drag force (or press load) from the second component (e.g., female screw member) increases. Thus, the internal pressure in the first pressure layer increases with the downward movement of the first component (e.g., male screw member) in the drive mechanism. Thus, a second pressure layer maybe formed and maintained in the second clearance between the second face (e.g., upward face) of the first component and the fourth face (e.g., downward face) of the second component using the pressure of the pressurized fluid increased when the press load exceeds the internal pressure of the first pressure layer. In other words, the second pressure layer is increased and maintained during the press load. Finally, the pressure in the second pressure layer is formed to be the same as the formed pressure of the first pressure layer in the non-press load producing time.

In other words, the second pressure layer is inversely formed while the thickness of the first pressure layer decreases. The thickness of the second pressure layer also increases. In such a process, vibration and noise may greatly be reduced.

As the first pressure layer subsequently disappears, the first and third faces are brought into direct contact with each other. Thus, the pressing power may be transmitted directly from the first component to the second component. In other words, the first and second components may be interconnected without loss in the transmission of pressing power.

As the slider moves upward after the pressing operation has been completed, the second pressure layer decreases and eventually disappears while the first pressure layer which is again formed and maintained, then increases.

Therefore, the present invention may provide a press machine which may improve the mechanical precision and pressing-product precision (or quality) and greatly reduce vibration and noise by eliminating any loss in the pressing power transmission.

The press machine according to the present invention may further comprise a slider positioning mechanism including a female screw member. This slider positioning device may adjust a position of the slider by rotating the female screw member. In this case, the suspension mechanism may include: a connecting rod having a top end connected to the drive mechanism; a male screw member having a top end pin-joined to a bottom end of the connecting rod, and a bottom end screwed in the female screw member; a retainer having a top end connected to the female screw member so as to move upward and downward with the female screw member; and a mounting member fixedly mounted between the retainer and the slider.

The mounting member may have a liquid-tight sealing member which liquid-tightly seals a lower portion of the female screw member and the retainer. The female screw member may have a downward face and an upward face dynamically opposing the downward face. The liquid-tight sealing member may have a first opposing face opposing the downward face of the female screw member. Moreover, the retainer may have a second opposing face opposing the upward face of the female screw member.

The relationship between the male screw member (or first component) and the female screw member (or second component) has previously been described. The similar relationship may be applied to the relationship among the female screw member, retainer and liquid-tight sealing member (mounting member).

In the relationship among the female screw member, the retainer and liquid-tight sealing member (mounting member), the first component may be the female screw member; the first face may be the downward face of the female screw member; and the second face may be the upward face of the female screw member. The second component may include the liquid-tight sealing member (mounting member) and the retainer, which are connected each other. The third face may be the first opposing face and the fourth face may be the second opposing face. The fluid may be charged into the first clearance between the downward face of the female screw member and the first opposing face of the liquid-tight sealing member, the second clearance between the upward face of the female screw member and the second opposing face of the retainer, and the passageway communicating between the first and second clearances.

In the non-press load producing time, a first pressure layer is formed by filling with the pressurized fluid between the downward face (or first face) of the female screw member (or first component) selected from the components forming the suspension mechanism and the first upward opposing face (or third face) of the mounting member (or second component) opposing the first face. As a result, a clearance (backlash) between the first and third faces apparently disappear while the first and second components are mechanically contacted (or connected) directly to each other through the pressurized fluid.

At the same time, the upward face (or second face) of the female screw member (or first component) dynamically opposing the downward face (or first face) of the same is pressed upward against the second downward opposing face (or fourth face) of the retainer (or second component) opposing the second face by the pressure (or upward lifting force) from the first face. Since the second face is thus brought into direct contact with the fourth face, no clearance (or backlash) is formed therebetween. Thus, the retainer receiving the entire weight of the slider may be supported by the female screw member.

In other words, the retainer and the mounting member (or second component) are mechanically connected to the female screw member (or first component) so as to mechanically transmit power without backlash (or clearance). Thus, vibration and noise may greatly be reduced during the press staring-up process, that is from a press start-up time in which the slider starts the downward movement to a time in which the press load starts to occur.

In the press load producing time in which the slider is further moved downward to initiate and continue the pressing operation, the upward drag force (or press load) from the slider increases. Thus, the internal pressure in the first pressure layer also increases as the female screw member (or first component) in the drive mechanism moves downward. Using the pressurized fluid increased by the fact that the press load exceeds the internal pressure of the first pressure layer, a second pressure layer may be formed and maintained in the second clearance between the female screw member (or first component) and the retainer (or second component). More specifically, the pressure of the second pressure layer is increased and maintained in the press load producing time. Eventually, the pressure in the second pressure layer is formed to be equal to the pressure of the first pressure layer produced in the non-press load producing time.

In other words, the second pressure layer is formed and maintained inversely as the thickness of the first pressure layer decreases. Subsequently, the thickness of the second pressure layer increases. During such process, vibration and noise ay greatly be reduced.

As the first pressure layer finally disappears, the downward face (or first face) of the female screw member (or first component) may be brought into direct contact with the first opposing face (or third face) of the mounting member (or liquid-tight sealing member: second component). Thus, the pressing power may be transmitted from the female screw member (or first component) directly to the mounting member (or second component). In other words, the mounting member (or second component) may be connected to the female screw member (or first component) without loss of press power transmission.

When the slider moves upward after completion of the pressing operation, the second pressure layer decreases and finally disappears while the first pressure layer is again formed and increased.

DESCRIPTION OF THE PREFERRED EMBODIMENT

The present invention will now be described by way of example with reference to the drawings.

Figure 3:
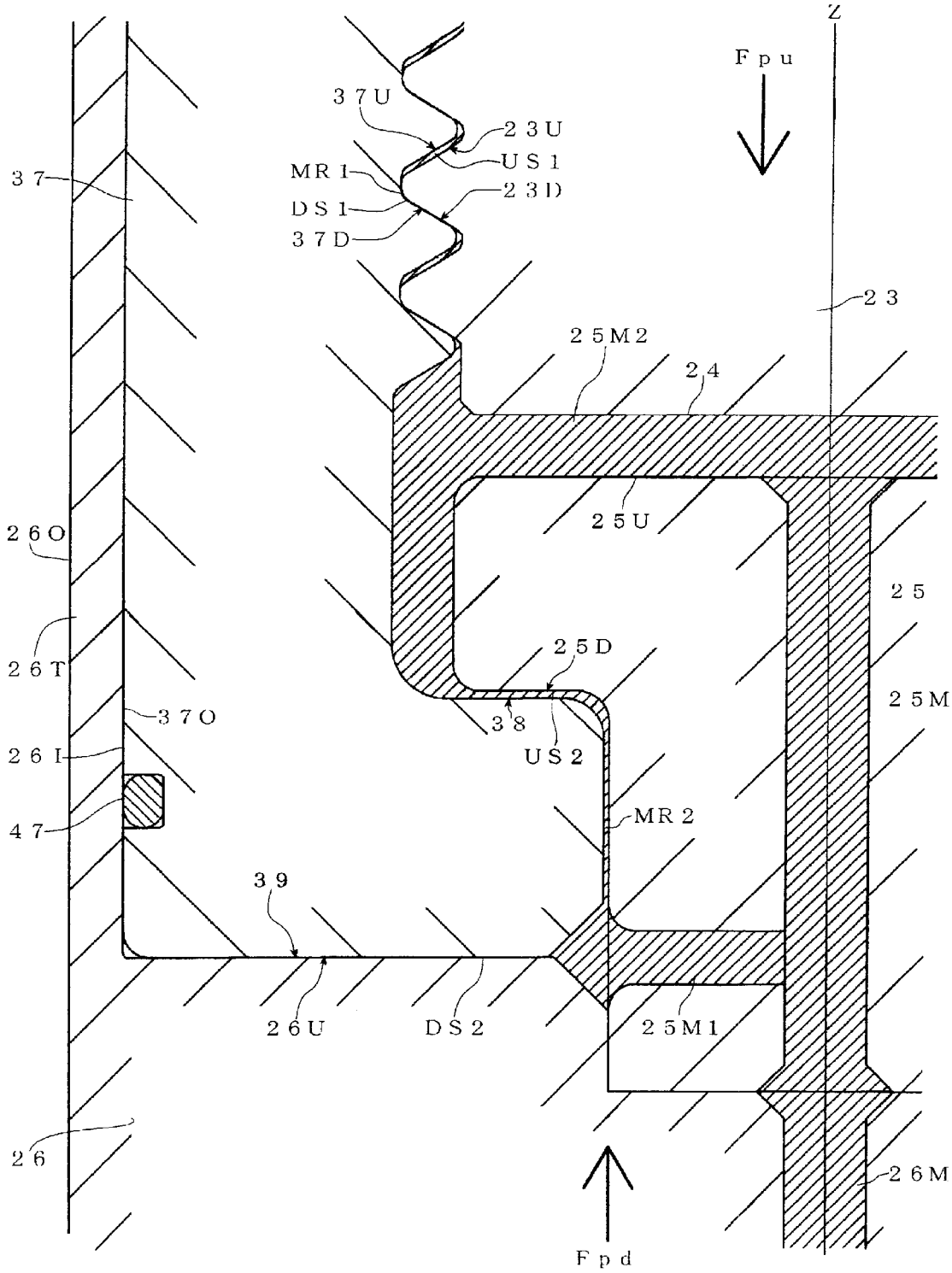
FIG. 3 is a vertical sectional view illustrating the suspension mechanism in a state different from that of FIG. 2.
Figure 4:
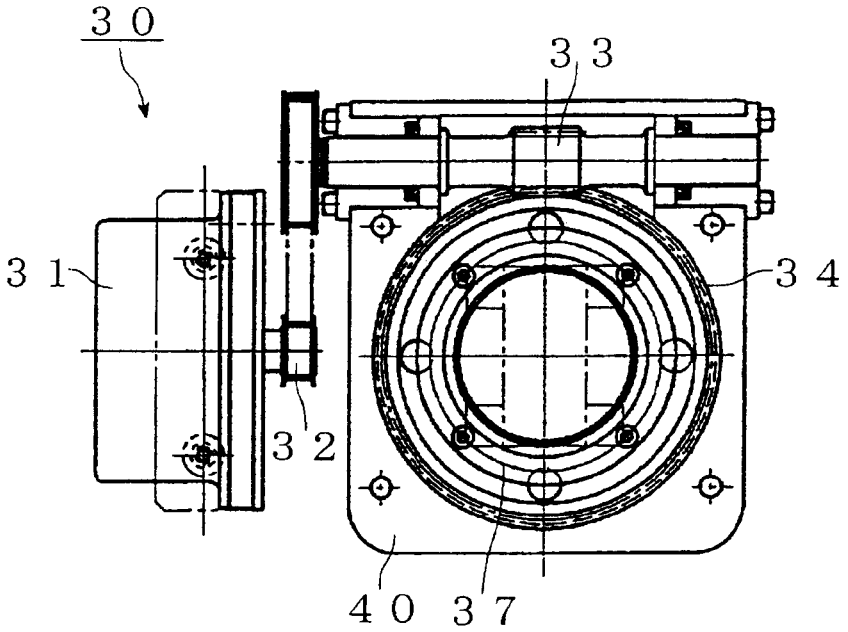
FIG. 4 is a plan view illustrating a slider positioning device as viewed along arrow line B—B in FIG. 1.
Figure 5:
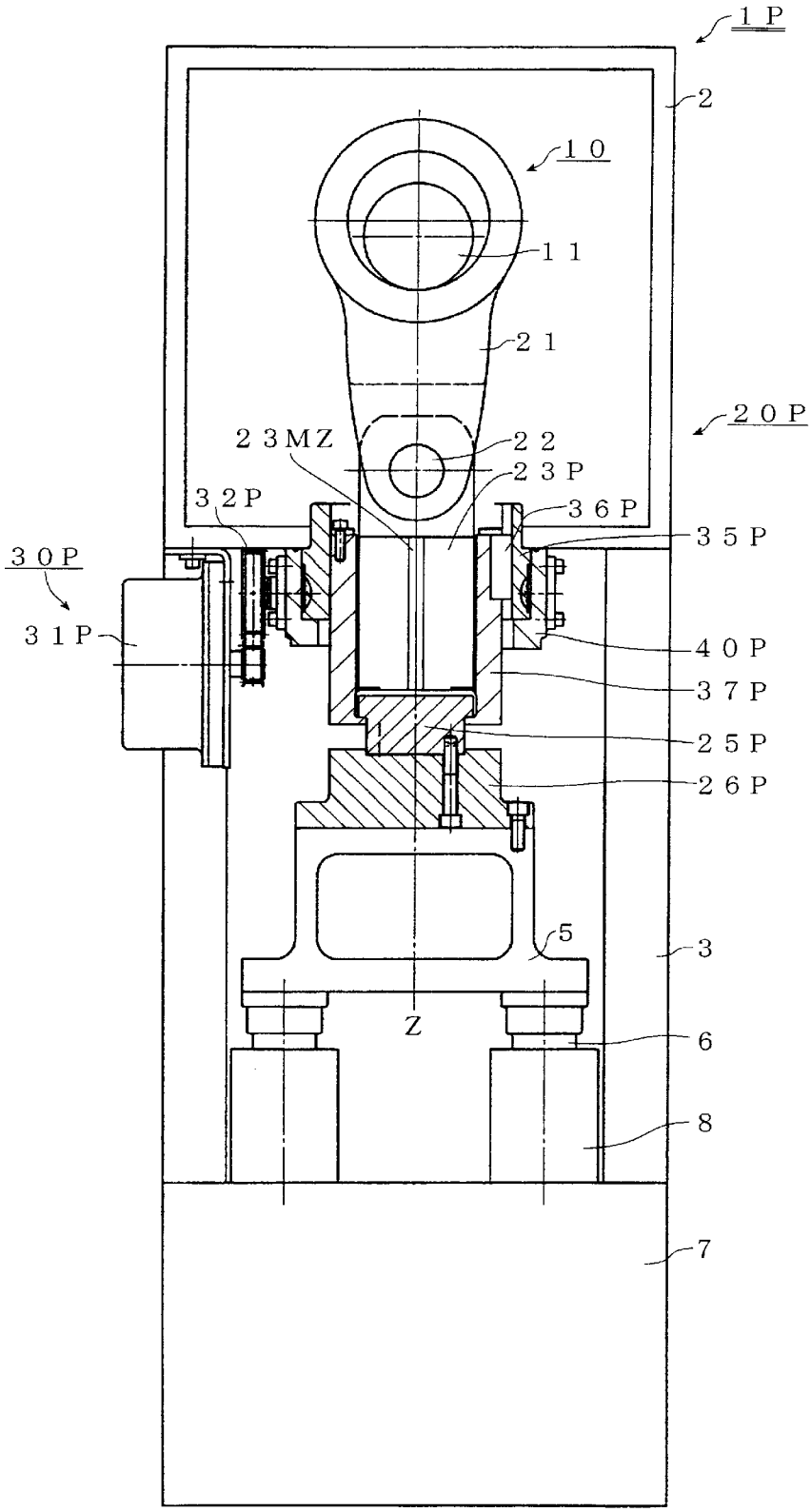
Prior Art FIG.5
FIG. 5 is a side cross-sectional view of a prior art.

Referring to FIGS. 1 to 4, a press machine 1 of the present invention is basically similar to a prior art shown in FIG. 5 except that it uses a mounting member 26 provided between a slider 5 and a retainer 25 as a liquid-tight sealing member. This mounting member (or liquid-tight sealing member) 26 liquid-tightly seals a suspension mechanism 20 by receiving the bottom end of a female screw member 37 and covering the underside of the retainer 25. The liquid-tight sealing member 26 includes a liquid supply passage 26M formed therethrough. A highly-pressurized liquid may initially be supplied into clearances formed between components such as liquid-tight sealing member 26, female screw member 37, male screw member 23 and retainer 25. The highly-pressurized liquid is supplied by an amount corresponding to the external leakage through the threaded connection between the female screw member 37 and the male screw member 23. Thus, the liquid pressure within the liquid-tight structure in the suspension mechanism 20 may be maintained in a predetermined range.

Figure 1:
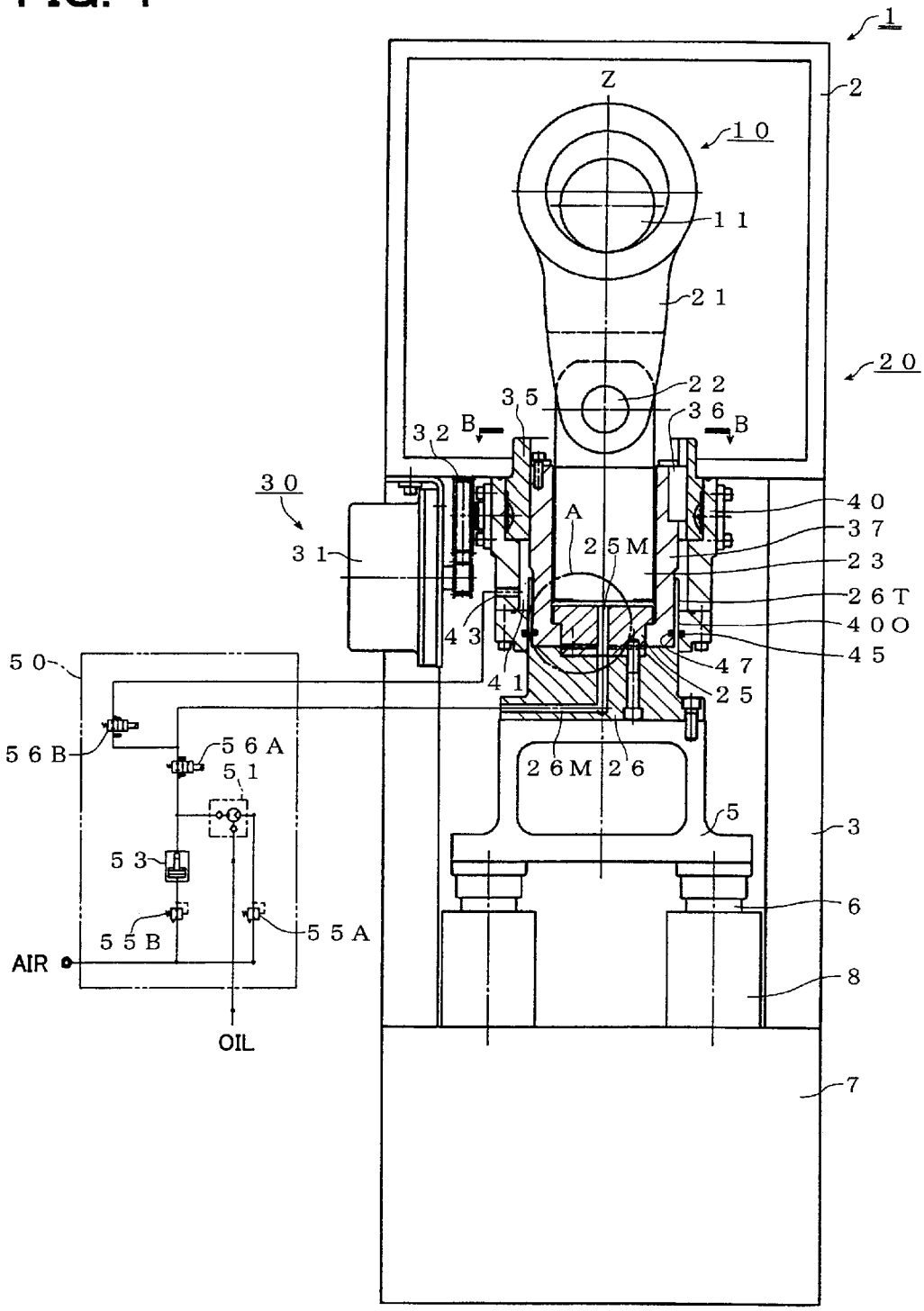
FIG. 1 is a front view and partially sectional view illustrating one embodiment of the present invention.

More specifically, as shown in FIG. 1, the press machine 1 comprises a drive mechanism 10 (including a crank shaft 11) and a slider 5. The drive mechanism 10 is operatively coupled with the slider 5 through the suspension mechanism 20 which includes a connecting rod 21 connected to the drive mechanism 10 (11), a male screw member 23 connected to the connecting rod 21, a female screw member 37 screwed over the male screw member 23 and forming a-slider positioning device 30 with the male screw member 23 and a retainer 25 having a top end mounted within the cylindrical bottom portion of the female screw member 37 and a bottom end integrally connected to the slider 5.

Figure 2:
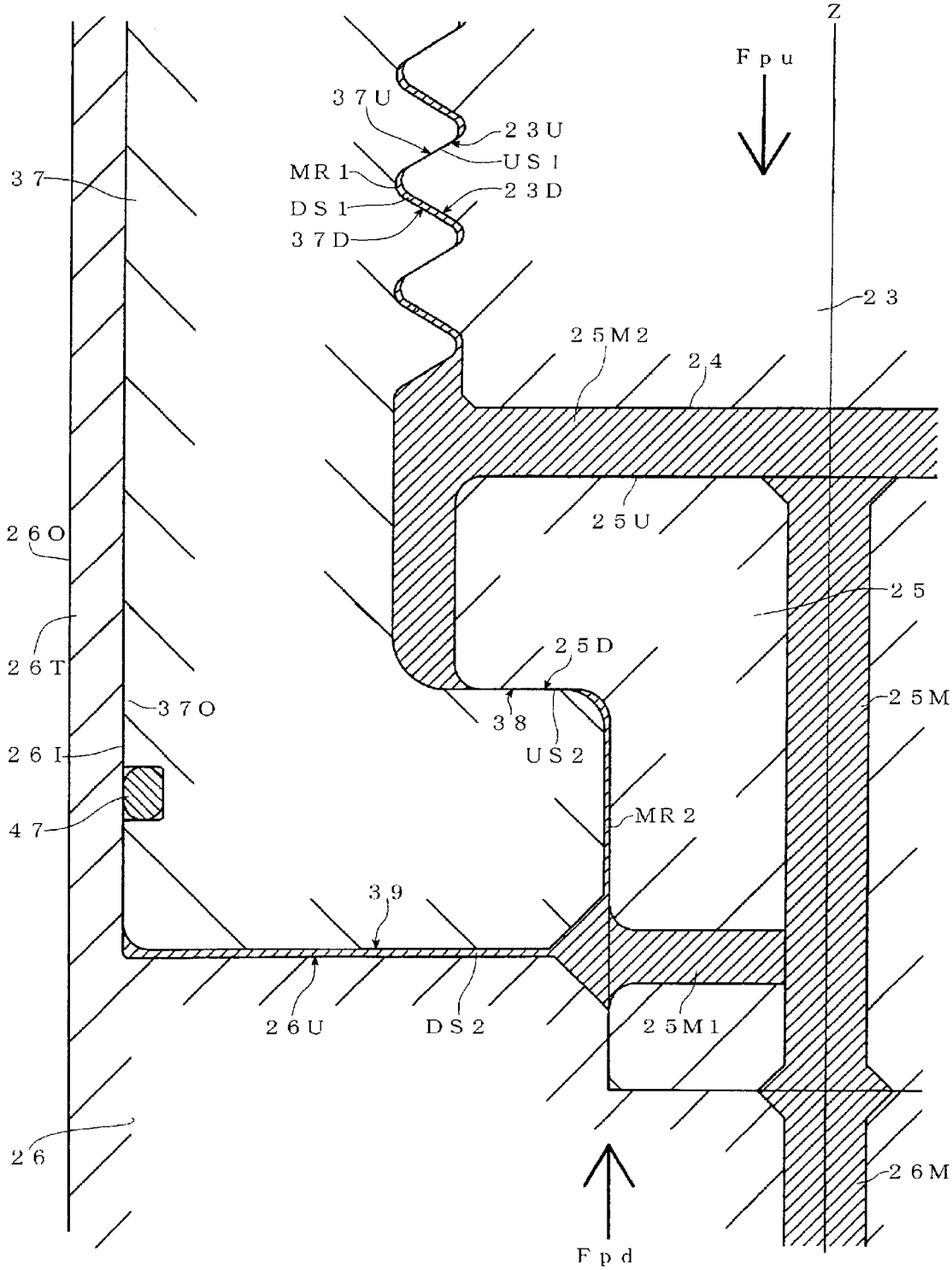
FIG. 2 is a vertical sectional view illustrating the details of a main part of a suspension mechanism.

According to the technical features of this embodiment, the pressurized fluid is supplied between a first face of a first component selected from the components forming the suspension mechanism 20 and a third face of a second component opposing the first face to form first pressure layers (DS1, DS2) in the non-press load producing time, as shown in FIG. 2. The pressure of the pressurized fluid within the first pressure layers (DS1, DS2) is increased in the press load producing time. As shown in FIG. 3, the increased pressure of the pressurized fluid is then utilized to form second pressure layers (US1, US2) between a second face of the first component dynamically opposing the first face of the first component and a fourth face of the second component opposing the second face. If the first pressure layers (DS1, DS2) disappear due to application of a load higher than the pressure of the first pressure layers (DS1, DS2), the first and third faces are brought into direct contact with each other. Thus, the pressing power may be transmitted from the first component to the second component. At the same time, the first and second components may be connected to each other without backlash for pressing power transmission.

The establishment of the second pressure layer (US1, US2) in the press load means that the second pressure layers (US1, US2) is initially maintained while increasing its pressure and that the pressure in the second pressure layers (US1, US2) finally becomes equal to that of the first pressure layers (DS1, DS2) in the non-press load producing time.

Although it is not intended to limit the relationships between the first and third faces and between the second and fourth faces relating to their directions, this embodiment will be described relating to the up-and-down relationship (including the slope state as in threaded faces 23D, 27D or others) since the driving force and press load reaction appear relating to the up-and-down direction due to the structure of the press machine 1.

Namely, in this embodiment, the first component is the male screw member 23, the first face being a downward male thread face 23D, the second face being a upward male thread face 23U having the same thread as that of the first face in the relationship between the male screw member 23 and the female screw member 37, as shown in FIGS. 1 and 2 (FIG. 2 shows the enlarged details enclosed by a two-dot chain circle A.) Furthermore, the second component is the female screw member 37, the third face being an upward female thread face 37D, and the fourth face being a downward female thread face 37U.

In the relationship between the female screw member 37, liquid-tight sealing member 26 and retainer 25, the first component is the female screw member 37, the first face being a downward face 39 and the second face being an upward face 38. The second component is formed by the liquid-tight sealing member 26 and retainer 25 which are integrally connected to each other. The third face is a first opposing face 26U of the liquid-tight sealing member 26 opposing the first face 39 of the female screw member 37 while the fourth face is a second opposing face 25D of the retainer 25 opposing the second face 38 of the female screw member 37.

A flow passage 25M2 is formed between an upward end face 25U of the retainer 25 and a downward end face 24 of the male screw member 23.

More particularly, the structure and function of the slider positioning device 30 (which comprises a motor 31, a rotational-power transmission mechanism 32, a worm shaft 33, a worm wheel 35, a key 36, a male screw member 23 and a female screw member 37) shown in FIG. 4 are similar to those of the prior art (which comprises components 30P . . . 31P, 32P, 35P, 36P, 23P, 37P and the worm shaft as shown in FIG. 5). However, the forms of the male and female screw members are different from those of the prior art except that the clearances (DS1, US1) between the treads shown in FIGS. 2 and 3 are micrified within the possible range.

Particularly, the clearance (MR1) formed between the top of the male thread and the root of the female thread is formed to be very narrow in comparison with the conventional thread structures so that the amount of the highly-pressurized liquid (lubricating oil, lubricant or the like) upwardly flowing through the thread groove in FIG. 1 may highly be reduced using the restricting action in the thread groove. In the prior art, however, the clearance is wider as in the conventional thread structure. Rather, the prior art tended to increase the clearance for gravity-drop lubrication (in which the top of the male thread is cut out).

The liquid-tight sealing member (or mounting member) 26 has a female-screw receiving portion 26T for receiving the bottom end of the female screw member 37. Thus, the liquid-tight sealing member 26 may cover the lower portion of the retainer 25.

O-ring 47 is sealingly located between the inner wall 26I of the female-screw receiving portion 26T and the outer wall 37O of the female screw member 37. O-ring 45 is sealingly located between the outer wall 26O of the female-screw receiving portion 26T and the inner wall 40O of a bracket 40 at the cylindrical lower end thereof. Thus, the suspension mechanism 20 may liquid-tightly be sealed.

Such a liquid-tight structure receives the lubricating oil (or highly-pressurized liquid) flowing downward to upward in the suspension mechanism 20 from a highly-pressurized oil generating device 50 through a liquid supply passage 26M having horizontal and vertical passage portions formed through the liquid-tight sealing member 26, a flow passage 25M formed vertically through the retainer 25 and flow passages 25M1, 25M2.

The lubricating oil flowing out of the top of the liquid-tight structure or screwing structure (23, 37) is collected by an oil sump 41 shown in FIG. 1 which is formed between the outer wall of the female-screw receiving portion 26T and the inner wall of the bracket 40. The lubricating oil is further fed back to the highly-pressurized oil generating device 50 through an exhaust passage 43 for re-circulation. The oil sump 41 and exhaust passage thus form a return passage.

As shown in FIG. 1, this highly-pressurized oil generating device 50 comprises a booster 51 for increasing the oil pressure by regulating the pressure or rate of air flow through a regulator 55A and an accumulator 53 for regulating the pressure of the highly-pressurized oil increased at the booster 51 by regulating the pressure or rate of air flow through a regulator 55B. The highly-pressurized oil generating device 50 also comprises electromagnetic valves 56A and 56B which may be actuated to release the highly-pressurized layers and to actuate the slider positioning device 30.

Operation in the Non-Press Load Producing Time

FIG. 2 illustrates the non-press load producing time.

The non-press load producing time (Fpu) extends from the press rest time to a point of time when the press load (Fpd) occurs after the press has been started up. In the non-press load producing time, the pressurized fluid (lubricating oil) is charged from the highly-pressurized oil generating device 50 through the liquid supply passage 26M and flow passages 25M, 25M2 into a first clearance (23D-37D) between the downward male thread face (or first face) 23D of the female screw member (or first component) 23 selected from the components forming the suspension mechanism 20 and the upward female thread face (or third face) 37D of the female screw member (or second component) 37 opposing the downward male thread face 23D. Thus, the first pressure layer DS1 is formed between the first clearance (23D-37D) between the first and third faces 23D, 37D.

Therefore, the first clearance which may occur between the downward male thread face 23D and the upward female thread face 37D apparently disappears, thereby providing a mechanical direct contact (or connection) therebetween through the pressurized fluid.

At the same time, the upward male thread face (or second face) 23U of the male screw member (or first component) 23 dynamically opposing the downward male thread face (or first face) 23D and forming the same thread is upward urged against the downward female thread face (or fourth face) 37U of the female screw member (or second component) 37 opposing the upward male thread face 23U by the pressure (or upward lifting force) from the downward male thread face 23D. Thus, the upward male thread face 23U is brought into direct contact with the downward female thread face 37U so that the second clearance is not generated therebetween.

In other words, the male screw member (or first component) 23 is mechanically connected to the female screw member (or second component) 37 for press power transmission without clearance. Thus, vibration and noise may greatly be reduced in the screwing structure (23, 37) during the press start-up process, that is, a time period starting from the beginning of the downward movement in the slider 5 and terminating at the beginning of press load occurrence.

The relationship between the female screw member 37, retainer 25 and liquid-tight sealing member 26 in the non-press load (Fpu) producing time will now be described. In this relationship, the female screw member is the first component, and the retainer and liquid-tight sealing member 25, 26 interconnected form the second component.

The pressurized fluid (lubricating oil) is charged from the highly-pressurized oil generating device 50 through the liquid supply passage 26M and passages 25M, 25M1 into the first clearance (39-26U) between the downward face (or first face) 39 of the female screw member (or first component) 37 and the first upward opposing face (or third face) 26U of the liquid-tight sealing member (or second component) 26 opposing the downward face 39. Thus, the first pressure layer DS2 is formed in the first clearance (39-26U).

Therefore, the first clearance between the downward face (or first face) 39 and the first opposing face (or third face) 26U apparently disappears, thereby providing a mechanical direct contact (or connection) therebetween through the pressurized fluid.

At the same time, the upward face (or second face) 38 of the female screw member (or first component) 37 dynamically opposing the downward face 39 thereof is upward urged against the second opposing face (or fourth face) 25D of the retainer 25 opposing the upward face (or second face) 38 by the pressure (or upward lifting force) from the downward face 39. At this time, it is considered that the vertical position of the retainer 25 is fixed.

Since the upward face (or second face) 38 is brought into direct contact with the second opposing face (or fourth face) 25D, the second clearance (backlash) may not occur therebetween (38-25D). The retainer 25 on which the weight of the slider 5 acts may be carried by the upward face 38 of the female screw member 37.

In such a manner, all of the retainer and liquid-tight sealing member 25, 26 forming the second component and the female screw member (or first component) 37 are mechanically interconnected for power transmission without backlash (clearance). Thus, vibration and noise may greatly be reduced in the combined female screw member/liquid-tight sealing member during the press start-up process, that is, a time period starting from the beginning of the downward movement in the slider 5 and terminating at the beginning of press load occurrence.

Operation in the Press Load Producing Time

The press load (Fpd) producing operation in which the drive mechanism 10 is actuated and the slider 5 is further downward moved to begin and advance the pressing operation will now be described with reference to FIG. 3.

First of all, the relationship between the male screw member (or first component) 23 and the female screw member (or second component) 37 will be described.

In the press load producing time period, the upward drag force (or press load Fpd) directed from the upward female thread face (or third face) 37D of the female screw member (or second component) 37 toward the male screw member (or first component) 23 increases. The downward male thread face (or second face) 23D of the male screw member 23 in the drive mechanism 10 is downwardly moved to increase the internal pressure within the first pressure layer DS 1. The pressurized fluid is then moved into the second clearance (23U-37U) between the upward male thread face 23U of the male thread member 23 and the downward female thread face 37U of the female thread member 37 through the screwing portion (or top clearance MR1).

In other words, the thickness of the first pressure layer DS1 decreases while the second pressure layer US1 is inversely formed in the second clearance (23U-37U) The thickness increases in the formed second pressure layer US1. During such a process, vibration and noise may greatly be reduced in the screw structure (23, 37).

As the first pressure layer DS1 subsequently disappears, the downward male thread face (or first face) 23D is brought into direct contact with the upward female thread face (or third face) 37D. Thus, the pressing power (Fpu) may directly be transmitted from the male screw member 23 to the female screw member 37.

In such a manner, the male screw member 23 maybe connected to the female screw member 37 for press power transmission without backlash. As the slider 5 is upward moved after termination of the pressing operation, the second pressure layer US1 decreases and finally disappears while the first pressure layer DS1 is again formed and increased in pressure.

Next, the relationship between the female screw member (or first component) 37 and the retainer/liquid-tight sealing member (or second component: 25, 26) will be described.

In the press load producing time, the upward drag force (or press load Fpu) from the slider 5 increases. The female screw member 37 in the drive mechanism 10 is thus downward moved to increase the internal pressure of the first pressure layer DS2. The pressurized fluid is then moved into the second clearance (38-25D) between the upward face (or second face) 38 of the female screw member 37 and the second opposing face (or fourth face) 25D of the retainer 25 through the clearance MR2 between the female screw member 37 and the retainer 25.

In other words, the thickness of the first pressure layer DS2 decreases while the second pressure layer US2 is inversely formed in the second clearance (38-25D). The thickness increases in the formed second pressure layer US2. During such a process, vibration and noise may greatly be reduced.

As the first pressure layer US2 subsequently disappears in the first clearance (39-26D), the downward face (or first face) 39 is brought into direct contact with the first opposing face (or third face) 26U. Thus, the pressing power (Fpu) may directly be transmitted from the female screw member (or first component) 37 to the mounting member (or liquid-tight sealing member) 26.

In such a manner, the female screw member (or first component) 37 may be connected to the retainer/liquid-tight sealing member (or first component) 25, 26 without backlash. As the slider 5 is upwardly moved after termination of the pressing operation, the second pressure layer US2 decreases and finally disappears while the first pressure layer DS2 is again formed and increased in pressure.

Thus, the press machine 1 may be provided to improve the mechanical precision and pressed product precision (or quality) and greatly reduce vibration and noise by eliminating any backlash in the press power transmission.

In comparison with the prior art in which the gravity-lubrication was carried out through the longitudinal lubricating-oil groove 23MZ formed through the male screw member 23, this embodiment may simply and surely perform the lubrication to the screwing portion (23, 37) which forms part of the slider positioning device 30 incorporated into the suspension mechanism 20. This also prevents the lubricating oil from being flowed to and contaminating the surrounding matters.

Independently of the magnitude of the clearance in the slider positioning device 30 (23, 37), the screwing portions (23, 37) have no backlash. Thus, the components may be brought into direct contact with each other under increased pressure while the frictional force therebetween may be maintained larger. As a result, the screwing portion is not loosened. Thus, the die height is not changed. Consequently, the occurrence of defects may be avoided to highly improve the yield.

The liquid-tight structure (or suspension mechanism 20) will further be described in detail. In the non-press load producing time, the highly-pressurized liquid (or lubricating oil) is initially supplied into the clearance formed between any adjacent components such as the female screw member 37, male screw member 23 and retainer 25. Since the press load (Fpd) does not still occur at this time, the first pressure layer DS2 is formed in the first clearance (39-26U), as shown in FIG. 2. Under the high pressure in the first pressure layer DS2, the upward face 38 of the female screw member 37 is brought into direct contact with the second opposing face 25D of the retainer 25 which is integrally formed with the slider 5.

As a result, the retainer 25 (or slider 5) is carried by the bottom end of the female screw member 37 under direct contact therewith. Thus, the vertical backlash between the female screw member 37 and the liquid-tight sealing member 26 (or slider 5) may be eliminated.

At the same time, the first pressure layer DS1 is formed in the first clearance (23D-37D) between the female screw member 37 and the male screw member 23. Under the high pressure in the first pressure layer DS1, the upward male thread face 23U of the male screw member 23 is urged against and contacted with the downward female thread face 37U of the female screw member 37. The same contacting state may be provided in the threads 23 and 37.

On the stoppage of pressing, the movable female screw member 37 is downward urged against the stationary male screw member 23 to bring the upward thread portions of the female and male screw members 37, 23 as viewed in the vertical direction into direct contact with each other. At the same time, the downward thread portions thereof may also be connected to each other without backlash under the action of the highly-pressurized layers.

In the press load producing time, the downward male thread face 23D of the movable male screw member 23 which may downwardly be moved by the drive mechanism 10 is constrained relating to its vertical position by the bed (or lower die) 7 through the female screw member 37, liquid-tight sealing member 26 and slider (or upper die) 5. Thus, the movable male screw member 23 is displaced (or downward moved) to the upward female thread face 37D of the stationary female screw member 37.

As a result, the first pressure layer DS1 decreases in thickness while the movable downward male thread face 23D may be brought into direct contact with the stationary upward female thread face 37D to attain the direct transmission of pressing power.

During and prior to such a process, the liquid (or oil) sequentially moves from the lower initially formed highly-pressurized layer through the clearance MR1 between the top of the male thread and the root of the female thread to the upper screwing portions. In other words, the upper highly-pressurized layer increases in thickness by an amount corresponding to the decreased thickness in the lower highly-pressurized layer.

Since the male and female screw members 23, 37 are spiral and continue in the vertical direction, the highly-pressurized liquid gradually upward moves and flows out of the upper portion. This gradually decreases the liquid pressure in the liquid-tight structure. Therefore, the highly-pressurized liquid is supplied from the underside (26M) by an amount corresponding to the external leakage through the screwing portions between the male screw member 23 and the female screw member 37 to maintain the liquid pressure in the liquid-tight structure (20) in a predetermined range. In such a case, the clearances in the respective screwing portions and between the top of the male thread and the root of the female thread function as restrictions. Therefore, the amount of the liquid to be supplied may be much less than the gravity-drop lubrication of the prior art. In addition, the liquid does not flow to the surrounding matters.

Since this embodiment may uniformly fill the respective clearances in the liquid-tight structure (20) with the highly-pressurized liquid, vibration and noise may greatly be reduced. In addition, the mechanical precision and pressed product precision may highly be improved since the respective clearances may be micrified.

In such a manner, this embodiment may perfectly eliminate the backlash in the transmission of pressing power. Therefore, the mechanical precision and product precision (or quality) may be improved while the vibration and noise may greatly be reduced.

Since each of the components such as screws, pressure receiving faces and pressurizing faces may positively be prevented from being floated from the corresponding component such as screws, pressurizing faces and pressure receiving faces, the power transmission may effectively be improved without unbalance relating to the load.

Independently of the magnitude of the clearance in the slider positioning device, the screwing portions may surely be lubricated and cooled. On the other hand, the screwing portion is not loosened since it does not have any backlash and since the components may be brought into direct contact with each other under high pressure while the frictional force between the contacting components may be maintained larger. In other words, the die height is not changed. Thus, the occurrence of defectives may be avoided to highly improve the yield.

Since the highly-pressurized liquid may uniformly be charged into the respective clearances in the liquid-tightly sealed structure, the vibration and noise may highly be reduced. Since the respective clearance may be micrified, the mechanical precision and pressed product precision may greatly be improved. And yet, the press machine according to this embodiment is simpler in structure and is more easily assembled and handled. In such a liquid-tightly sealed structure, furthermore, the screwing structure in the slider positioning device may simply and stably be lubricated and cooled. In addition, the liquid (or oil) is less consumed and does not contaminate the surrounding matters.

The present invention is not limited to the aforementioned embodiments, but may be carried out in any of various other forms without departing the spirit and scope of the invention as claimed in the appending claims. For example, each of the first and second components may be in the form of a single piece such as the male screw member 23 and female screw member 37. Alternatively, each of the components may be formed by a plurality of pieces interconnected such as the retainer/liquid-tight sealing member 25, 26.

What is claimed is:

1. A press machine comprising:

a slider;

a suspension mechanism connected to the slider; and a drive mechanism which reciprocates the slider through the suspension mechanism, wherein the suspension mechanism includes:

at least one first component having a first face and a second face dynamically opposing the first face, the first component receiving a pressing power;

at least one second component having a third face opposing the first face through a first clearance, and a fourth face opposing the second face through a second clearance;

a passageway communicated between the first and second clearances;

a fluid which is pressurized and charged into the first and second clearances and the passageway, wherein a first pressure layer filled with the fluid is formed in the first clearance in a non-press load producing time, the fluid is flowed by a pressure increased in the first clearance into the second clearance through the passageway to form a second pressure layer filled with the fluid in a press load producing time, and disappearance of the first clearance and the first pressure layer brings the first and third faces into direct contact with each other, such that the pressing power is transmitted from the at least one first component to the at least one second component through the direct contact between the first and third faces;

a slider positioning device including a female screw member wherein the slider positioning device adjusts a position of the slider by rotating the female screw member, and wherein the suspension mechanism includes:

a connecting rod having a top end connected to the drive mechanism;

a male screw member having a top end pin-joined to a bottom end of the connecting rod, and a bottom end screwed in the female screw member;

a retainer having a top end connected to the female screw member so as to move upward and downward with the female screw member;

a mounting member fixedly mounted between the retainer and the slider; and wherein the mounting member has a liquid-tight sealing member which liquid-tightly seals a lower portion of the female screw member and the retainer, the female screw member has a downward face and an upward face dynamically opposing the downward face, the liquid-tight sealing member has a first opposing face opposing the downward face of the female screw member, and the retainer has a second opposing face opposing the upward face of the female screw member.

2. The press machine as defined by claim 1, further comprising a fluid supply device which pressurizes and supplies the fluid into the first clearance, the second clearance and the passageway.

3. The press machine as defined by claim 2, wherein the fluid supply device supplies the fluid by an amount flows out between the first and second components to maintain a pressure of the fluid in a predetermined range.

4. The press machine as defined by claim 3, further comprising a return passage for returning the fluid flows out between the first and second components to the fluid supply device.

5. The press machine as defined by claim 1, wherein the at least one first component is the male screw member, the first face is a downward male thread face, the second face is an upward male thread face forming the same thread as in the downward male thread face, the at least one second component is the female screw member, the third face is an upward female thread face, and the fourth face is a downward female thread face, and wherein the first clearance, the second clearance and the passageway filled with the fluid are formed between the female screw member and the male screw member.

6. The press machine as defined by claim 1 wherein the at least one first component is the female screw member, the first face is the downward face, and the second face is an upward face, wherein the at least one second component includes the liquid-tight sealing member and retainer connected each other, the third face is the first opposing face, and the fourth face is the second opposing face, and wherein the fluid is charged into the first clearance between the downward face of the female screw member and the first opposing face of the liquid-tight sealing member, the second clearance between the upward face of the female screw member and the second opposing face of the retainer, and the passageway communicating between the first and second clearances.

7. The press machine as defined by claim 1, wherein one of two the first components is the male screw member, the first face is a downward male thread face, the second face is an upward male thread face forming the same thread as in the downward male thread face, one of two the second components is the female screw member, the third face is an upward female thread face, and the fourth face is a downward female thread face, wherein the first clearance, the second clearance and the passageway filled with the fluid are formed between the female screw member and the male screw member, wherein the other of two the first components is the female screw member, the first face is the downward face and the second face is an upward face, wherein the other of two the second components includes the liquid-tight sealing member and retainer connected each other, the third face is the first opposing face, and the fourth face is the second opposing face, and wherein the fluid is charged into the first clearance between the downward face of the female screw member and the first opposing face of the liquid-tight sealing member, the second clearance between the upward face of the female screw member and the second opposing face of the retainer, and the passageway communicating between the first and second clearances.

8. The press machine as defined by claim 7, further comprising a supply passage formed in the suspension mechanism, for feeding the fluid into the first clearance, the second clearance and the passageway.

9. The press machine as defined by claim 8, wherein part of the supply passage is formed through the retainer and the mounting member.

10. The press machine as defined by claim 8, wherein a cross-sectional area of the supply passage is larger than a cross-sectional area of each of the first clearance, second clearance and passageway.

11. The press machine as defined by claim 8, further comprising a fluid supply device which pressurizes and supplies the fluid into the supply passage.

12. The press machine as defined by claim 11, wherein the fluid supply device supplies the fluid by an amount flows out through an opening of the female screw member to maintain a pressure of the fluid within the suspension mechanism in a predetermined range.

13. The press machine as defined by claim 12, further comprising a return passage for returning the fluid flows out through the opening of the female screw member to the fluid supply device.

* * * * *